United States Patent [19]

DiMaggio

[11] Patent Number: 5,034,582

[45] Date of Patent: Jul. 23, 1991

[54] MOMENTARY ROTATING MERCURY SWITCH

[76] Inventor: Darryl DiMaggio, 8447 Park Pl. #39, Houston, Tex. 77017

[21] Appl. No.: 500,563

[22] Filed: Mar. 28, 1990

[51] Int. Cl.[5] ..... H01H 29/22

[52] U.S. Cl. ..... 200/220; 200/224; 200/61.46; 200/61.47

[58] Field of Search ..... 200/220, 224, 225, 228, 200/229, 232, 235, 61.52, 61.46, 61.47

[56] References Cited

U.S. PATENT DOCUMENTS

| | | | |
|---|---|---|---|
| 489,266 | 1/1893 | Rabbidge | 200/225 |
| 1,880,832 | 10/1932 | Cramblet | 200/224 |
| 1,951,162 | 3/1934 | Moos | 200/228 |
| 2,744,175 | 5/1956 | Moore | 200/228 |
| 2,830,159 | 4/1958 | Varner | 200/220 |
| 2,849,550 | 8/1958 | Olmer et al. | 200/224 |
| 4,536,727 | 8/1985 | Romano | 200/220 |

*Primary Examiner*—Henry J. Recla
*Assistant Examiner*—Glenn T. Barrett

[57] ABSTRACT

A device for the detection of rotation having a hollow, pillbox shaped cylinder, a solid baffle positioned within the cylinder for directing the flow of mercury, at least two metal contacts within the cylinder, a non-mercury center rod contact, and mercury contained within the cylinder. The baffle is attached to a wall of the cylinder and extends radially inward therefrom. The baffle extends for a distance approximately equal to a radius of the cylinder. The first and second metal contacts are positioned on opposite sides of the baffle. A third metal contact is attached to the cylinder and extends inwardly therefrom distal the first and second metal contacts. The non-mercury center rod is positioned along a longitudinal axis of the cylinder.

2 Claims, 7 Drawing Sheets

MOMENTARY ROTATING MERCURY SWITCH

FIELD OF THE INVENTION

The field of the present invention is electricity, circuit makers and breakers. Specifically, the present invention is directed to a unique and novel momentary rotating mercury switch which detects rotation at very slow to moderate speeds by pouring over a baffle to make an electrical connection.

BACKGROUND OF THE INVENTION

Mercury switches have been known for years with successful applications from air controlling thermostats to light switches and even liquid leveling switches. These switches have proven to be durable and long-lasting.

SUMMARY OF THE PRESENT INVENTION

The present invention describes a design for a momentary rotating mercury switch (hereinafter referred to as the mercury switch). The operation of the mercury switch is quite unusual and the potential applications are numerous. The mercury switch may be used to detect rotation at very slow to moderate speeds and may be used to complete an electrical connection. One such application for the present invention may be an illuminated wheel cover for a vehicle wherein rotation detection at very slow to moderate speeds would be necessary to create an electrical connection for illuminating the wheel cover.

The mercury switch is preferably a hollow, pillbox shaped cylinder, including a baffle covering the length of the cylinder's radius, a suitable amount of mercury and metal contacts. The mercury switch is mounted to a compatible device, such as an illuminating wheel cover, at its most effective location for detecting rotation. As the vehicle begins to move, the mercury—due to gravity—is gathered at the lowermost point and either makes no contact or contact with only one side of the switch. Depending on the rotation position, the mercury pours down from the baffle, over the center rod contact and makes a momentary electrical connection. This process is done within the first revolution.

As the vehicle increases speed, centrifugal force spreads the mercury along the inside wall of the pillbox shaped cylinder, creating the means for a centrifugal switch. The electrical connection created by the mercury switch may be transferred to other electronic means for continuing the current for a desired period of time.

An object of the present invention is to provide a unique means of detecting rotation.

Another object of the present invention is to provide a means of completing an electrical connection within one revolution.

Still another object of the present invention is to provide a centrifugal switch within the mercury switch.

DESCRIPTION OF THE PREFERRED EMBODIMENT

Figure 1:
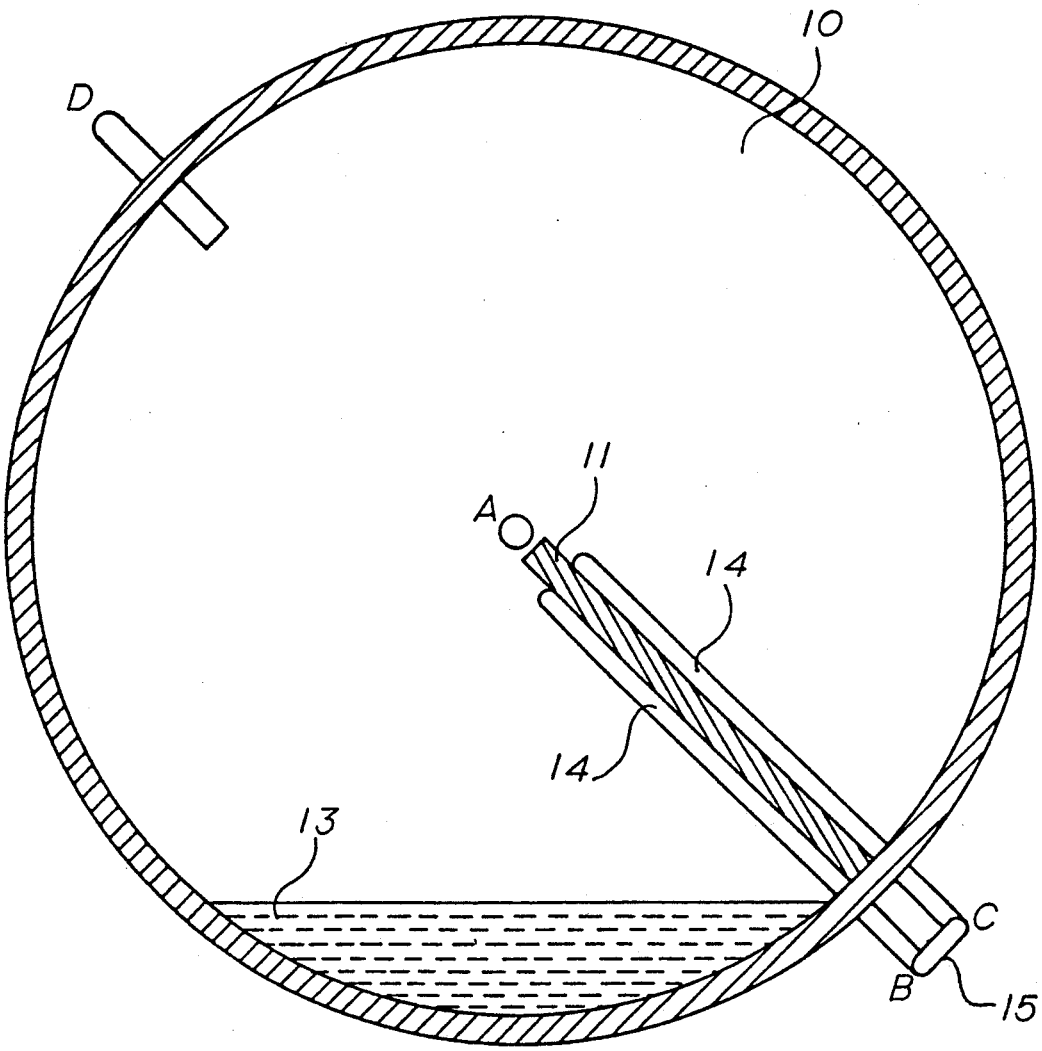
FIG. 1 is an exploded front view of the present invention in single pole, single throw configuration at a stationary position.

Now referring in detail to the drawings. The mercury switch of the present invention is preferably a hollow, pillbox shaped cylinder 10 comprising a solid baffle 11 which is attached to and extends from one side of the hollow, pillbox shaped cylinder 10 and is approximately the length of the cylinder's 10 radius. Also the pillbox shaped cylinder 10 comprises a center rod contact 12 which may be of suitable metal or alloy whereby no negative reaction to mercury 13 may occur. The center rod contact 12 may be positioned through the axis or center of rotation 18 and parallel with the axis 18; making up one side of a single pole, single throw switch.

Figure 7:
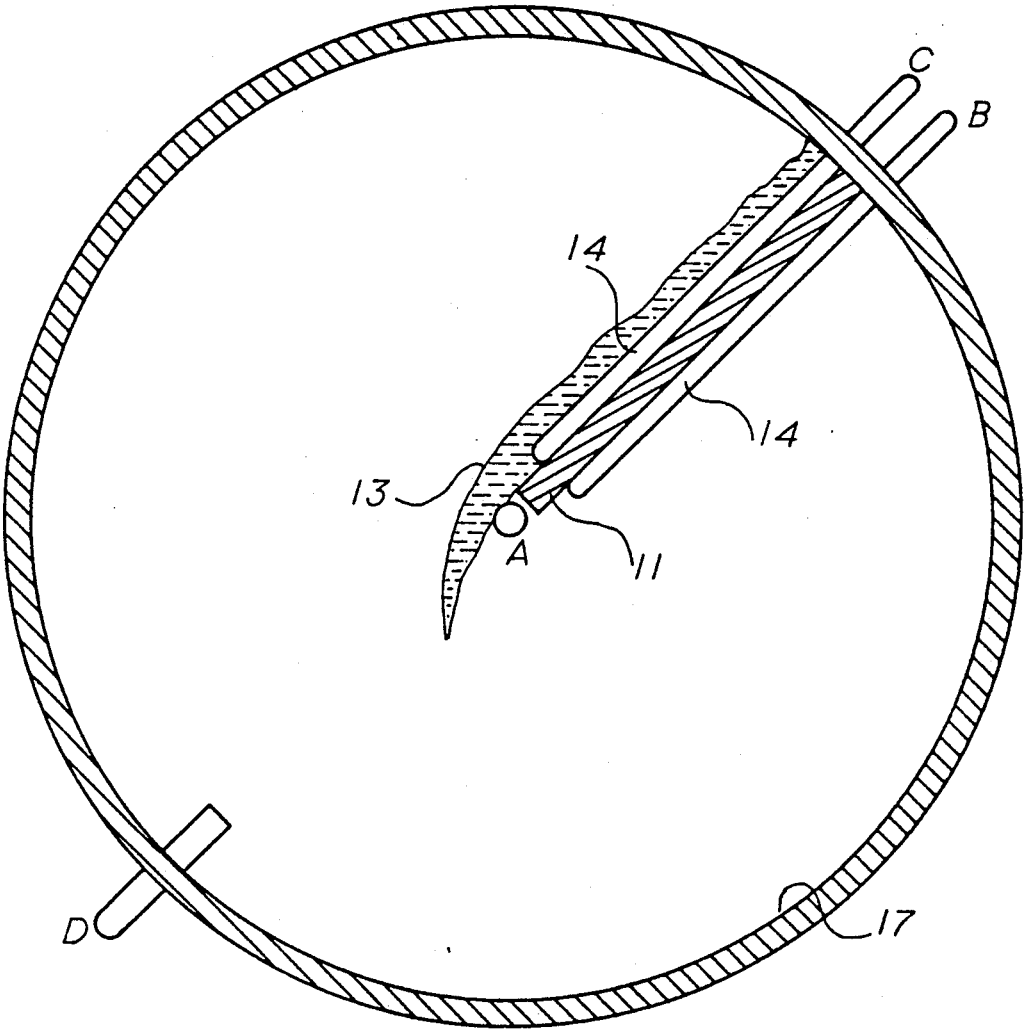
FIG. 7 is an exploded view of the present invention illustrating the electrical connection being made from the opposite direction.

Two metal contacts 14 are positioned directly along each side of the baffle 11, but cease just before the center point of the radius. These two metal contact 14 are non-mercury and may be made of several forms as long as they are of the proper metal or alloy. These two metal contacts 14 are electrically joined together through the outside wall of the present invention by a connection 15 to make up one side of the mercury switch. In this configuration, single pole, single throw, the mercury switch will detect motion in either direction of rotation. However, the two metal contacts 14 could be electronically separate so as to make a single pole, double throw switch which would not only detect rotation, but also distinguish rotational direction as seen in FIG. 7. Going further, multiple poles may be added to create a variety of further uses.

Figure 2:
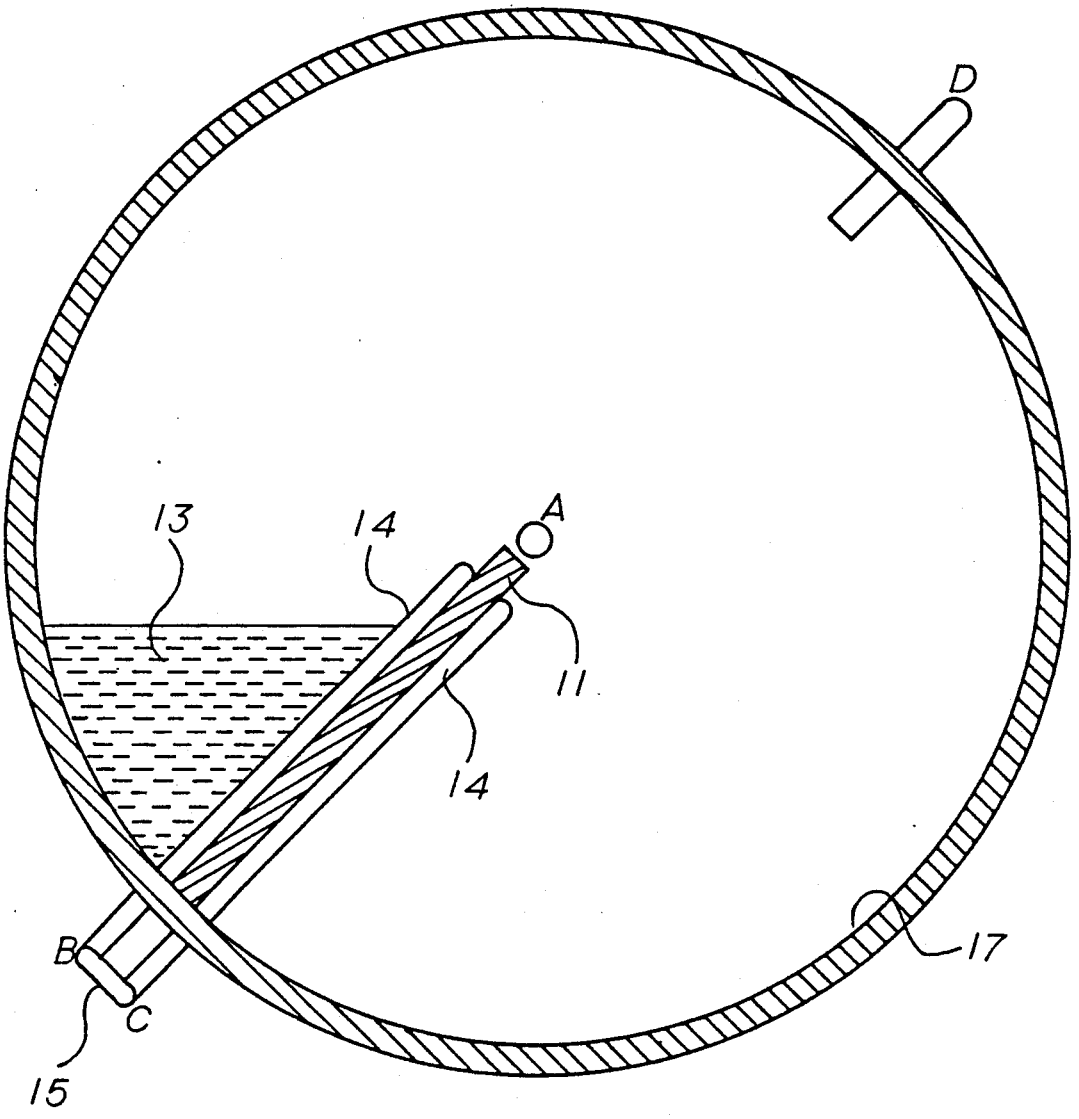
FIG. 2 is an exploded front view of the present invention in single pole, single throw configuration as rotation begins and the baffle collects mercury.
Figure 3:
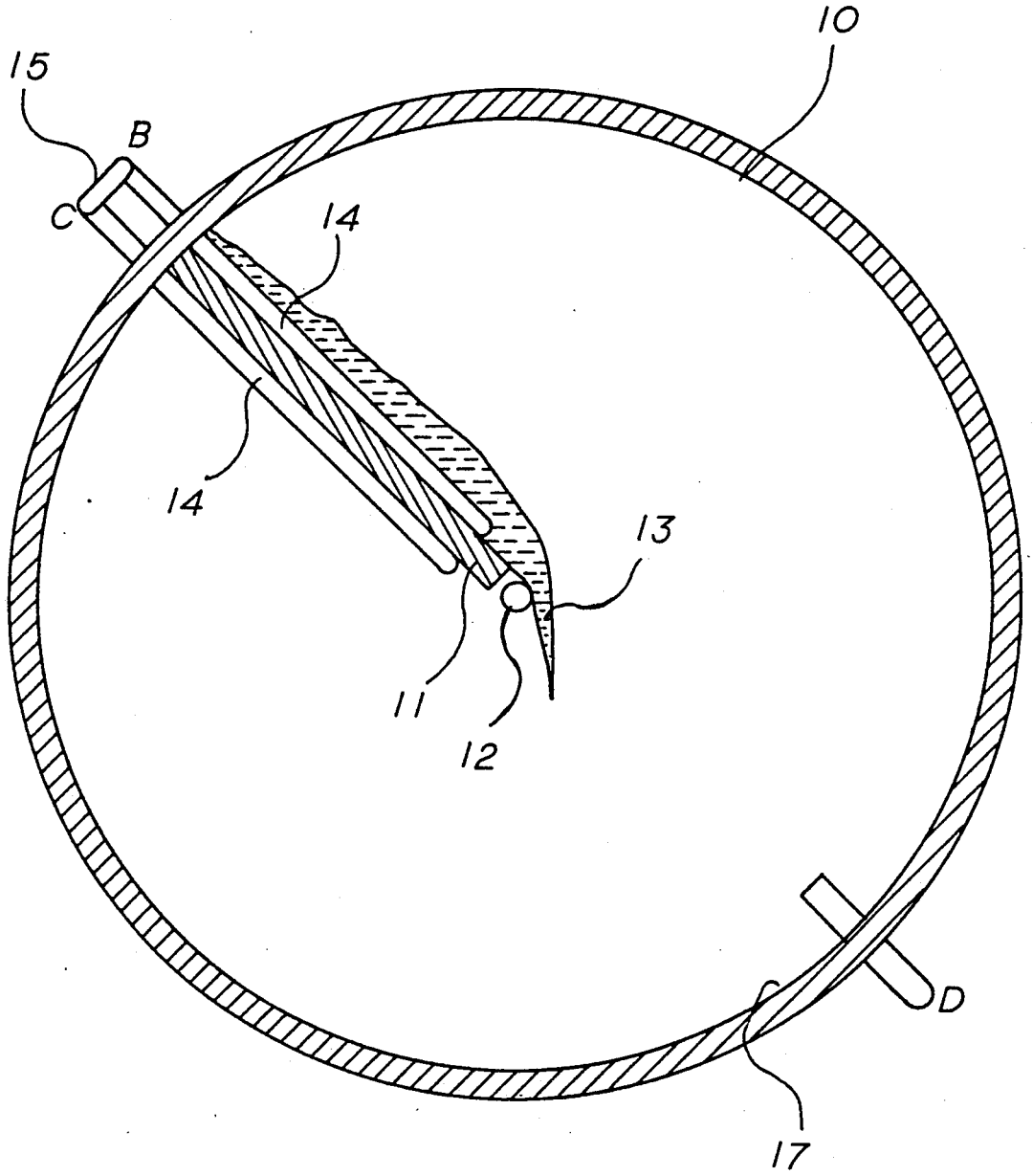
FIG. 3 is an exploded front view of the present invention in single pole, single throw configuration as mercury pours over the baffle to make electrical connection.

Referring to FIG. 1, in the initial operation the mercury 13, due to gravity, is gathered at the lowermost point 17; making contact with only one side of the metal contacts 14 regardless of rotation position. As rotation begins (see FIG. 2) the baffle 11 gathers mercury 13 from the lowermost point 17 and elevates the mercury 13. As shown in FIG. 3, rotation continues and the mercury 13 pours down along the baffle 11, over center rod contact 12 and makes a momentary electrical connection between the center rod contact 12 and one of the metal contacts 14 which are positioned directly against the baffle 11. The preceding process should occur within the first revolution regardless of the speed of rotation.

Figure 4:
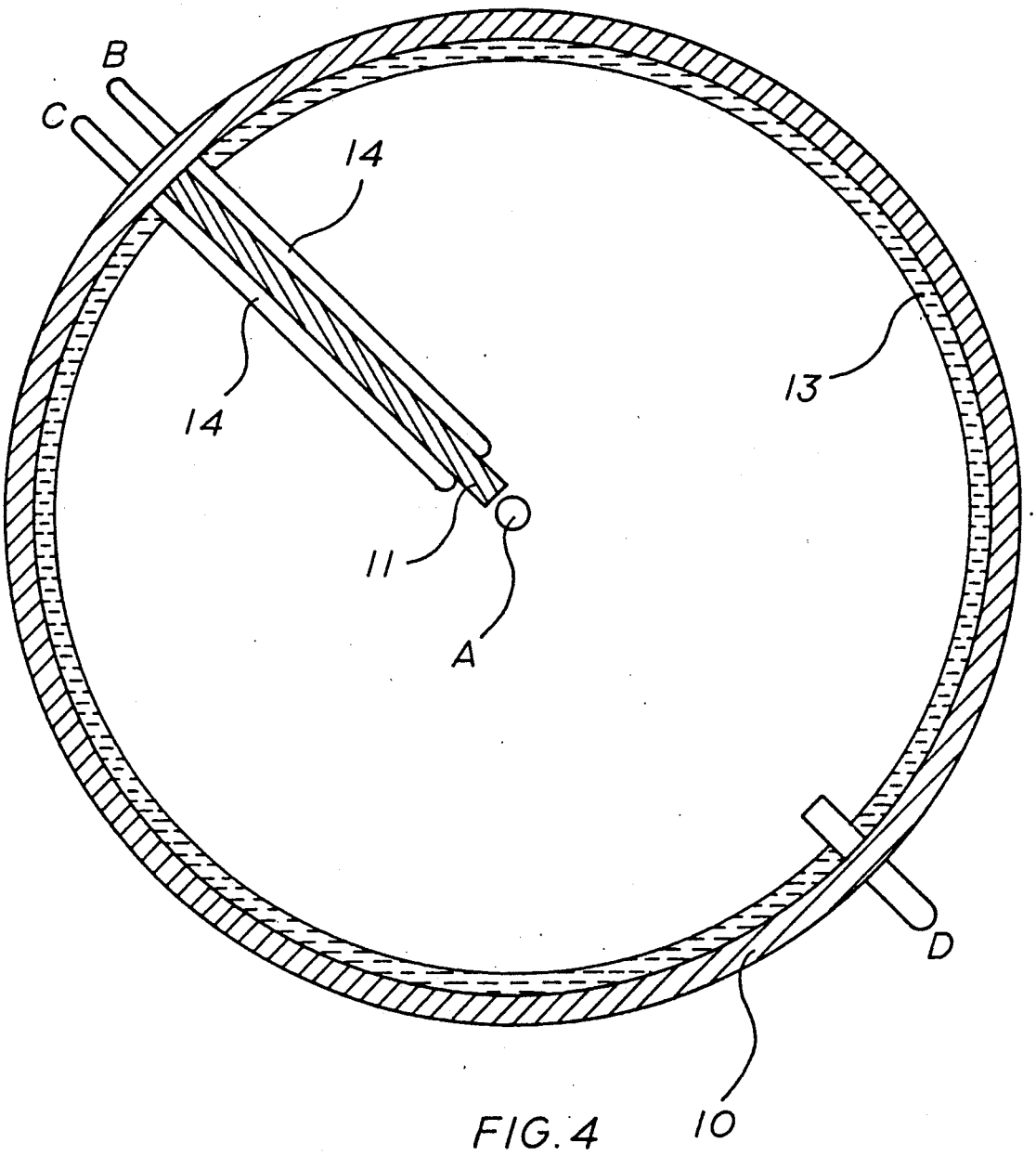
FIG. 4 is an exploded front view of the present invention in single pole, single throw configuration illustrating mercury coating walls of the cylinder during high speed rotation, creating a centrifugal switch.
Figure 5:
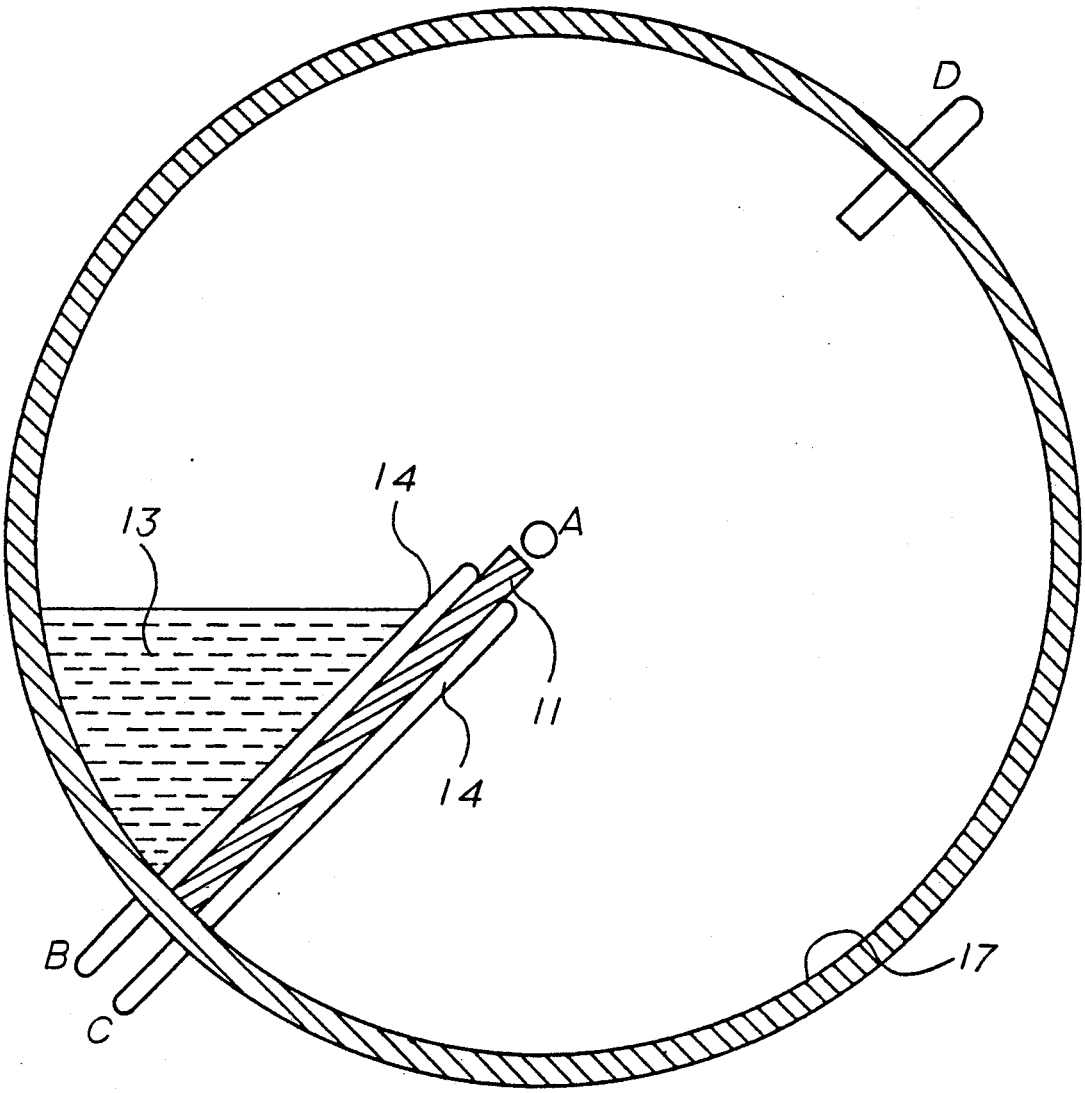
FIG. 5 is an exploded front view of the present invention in single pole, double throw configuration illustrating the baffle gathering mercury as rotation begins.
Figure 6:
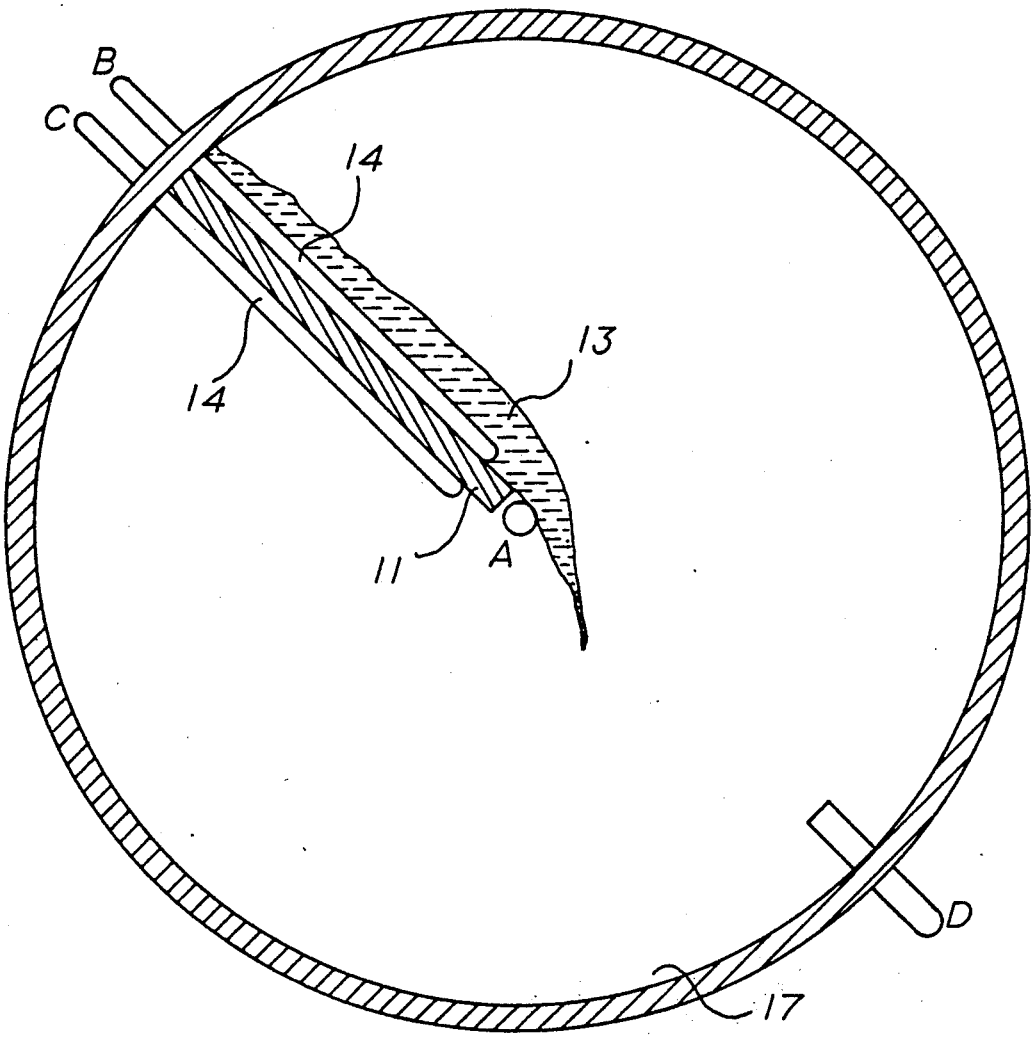
FIG. 6 is an exploded front view of the present invention in illustrating mercury pouring over the baffle to make an electrical connection.

As shown in FIG. 4, the rotational speed may increase resulting in the mercury 13 being spread along the inside walls of the cylinder 10 to create a centrifugal switch.

The foregoing description of the invention has been directed to a particular preferred embodiment of the present invention for purposes of explanation and illustration. It will be apparent to those skilled in the art that many modifications and changes in the momentary rotating mercury switch may be made without departing from the scope and spirit of the invention. It is, therefore, intended that the following claims cover such modifications and changes:

What I claim is:

1. A device for the detection of rotation comprising:

a hollow, pillbox shaped cylinder;

a solid baffle positioned within said cylinder for directing flow of mercury, said baffle attached to a wall of said cylinder and extending radially inwardly therefrom, said baffle extending for a distance approximately equal to a radius of said cylinder;

at least two metal contacts within said cylinder, a first metal contact attached to said cylinder so as to extend along one surface of said baffle, a second metal contact attached to said cylinder so as to extend along an opposite surface of said baffle, said first and second metal contacts arranged parallel to each other and to said baffle, and a third metal contact attached to said cylinder and extending inwardly of said cylinder, said third metal contact distal said first and second metal contacts;

a non-mercury center rod contact positioned within said cylinder along a longitudinal axis of said cylinder; and mercury contained within said cylinder.

2. A device for the detection of rotation in claim one wherein said first and second metal contacts include an electrical connection joining said first and second metal contacts together whereby providing continuous electrical current.

* * * * *